US007943838B2

(12) United States Patent
Dunwoodie

(10) Patent No.: US 7,943,838 B2
(45) Date of Patent: May 17, 2011

(54) SADDLE FOR STRINGED INSTRUMENTS

(76) Inventor: David Andrew Dunwoodie, Delta (CA)

( * ) Notice: Subject to any disclaimer, the term of this patent is extended or adjusted under 35 U.S.C. 154(b) by 0 days.

(21) Appl. No.: 11/967,246

(22) Filed: Dec. 30, 2007

(65) Prior Publication Data

US 2009/0038461 A1 Feb. 12, 2009

Related U.S. Application Data

(63) Continuation-in-part of application No. 11/569,228, filed on Nov. 16, 2006, now abandoned, and a continuation-in-part of application No. 10/847,849, filed on May 17, 2004, now abandoned.

(51) Int. Cl.
*G10D 3/04* (2006.01)

(52) U.S. Cl. ..... 84/298; 84/291

(58) Field of Classification Search ..... 84/298, 84/291

See application file for complete search history.

(56) References Cited

U.S. PATENT DOCUMENTS

| | | | | |
|---|---|---|---|---|
| 4,314,495 | A * | 2/1982 | Baggs | 84/731 |
| 5,463,185 | A * | 10/1995 | Fishman | 84/731 |
| 6,689,943 | B2 * | 2/2004 | McGuire et al. | 84/291 |
| 2003/0172793 | A1 * | 9/2003 | Hori | 84/298 |
| 2004/0249293 | A1 * | 12/2004 | Sandler et al. | 600/481 |

* cited by examiner

*Primary Examiner* — Jianchun Qin

(57) ABSTRACT

A saddle for a stringed instrument comprising an elongate member having a string support surface and a base that abuts the stringed instrument. The elongate member has at least one internal cavity and a pickup element received in the internal cavity, the element being dimensioned to provide an airspace gap between the element and the base of the elongate member to provide a separation between the element and the instrument. The airspace gap between the element and the base of the saddle means that no pressure is applied to the bottom of the element, thereby eliminating string imbalance due to uneven pressure between the saddle and the instrument.

7 Claims, 4 Drawing Sheets

FIG. 2
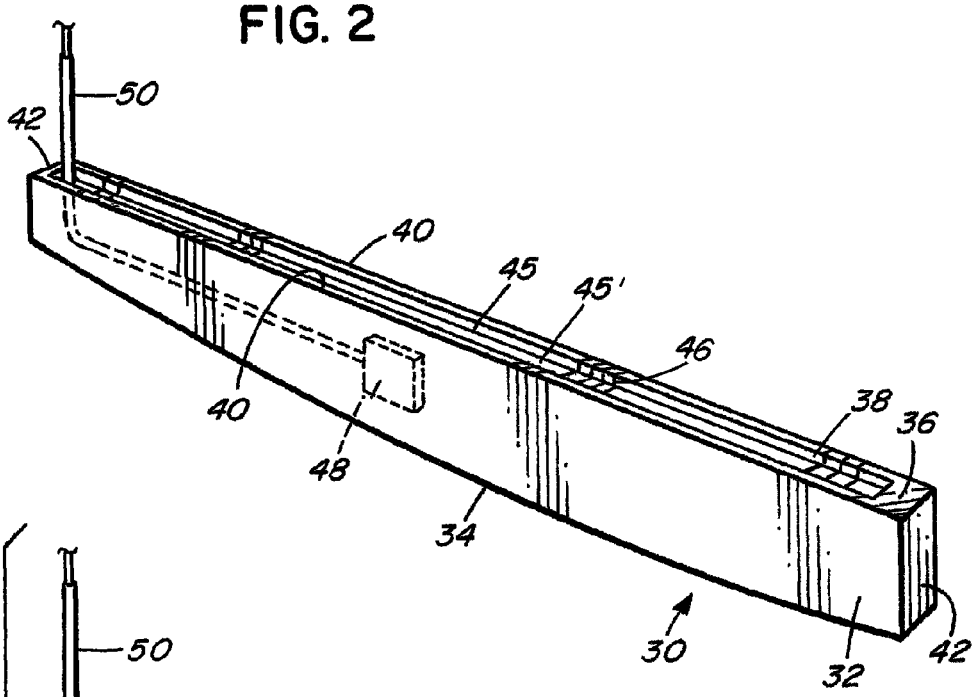
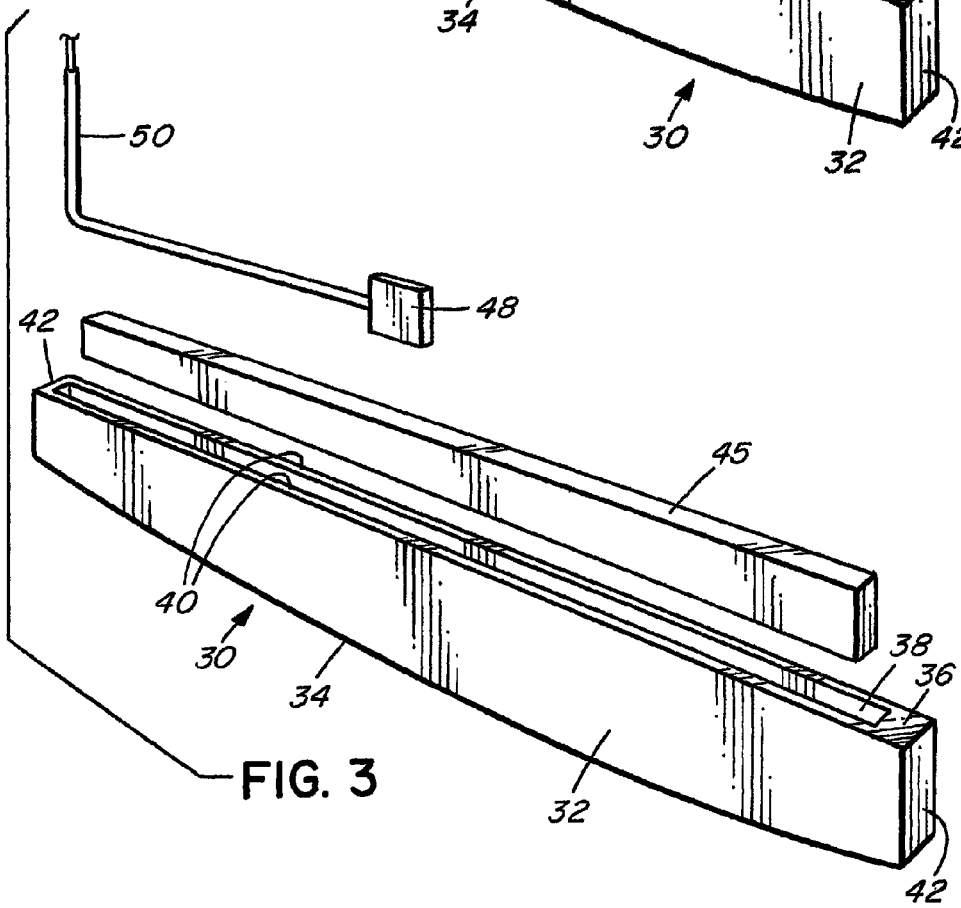
FIG. 3

SADDLE FOR STRINGED INSTRUMENTS

BACKGROUND OF THE INVENTION

1. Field of Invention

The present invention relates generally to a saddle apparatus for stringed musical instruments, and more particularly, to improved saddle designs that provide a gap or separation between one or more electric pickup elements and the bridge of the instrument on which the saddle is fitted, thereby eliminating string imbalance due to uneven pressure between the saddle and the instrument and enabling accurate reproduction and amplification of the sound of the strings.

2. Background of the Invention and Description of Related Art

A conventional acoustical stringed instrument comprises a hollow body having a front face or sounding board, a back face which is substantially parallel to the sounding board, and a connecting portion which connects the sounding board to the back face around a perimeter of the respective faces. A longitudinally extending neck member extends from the body and has a distal end having a plurality of string receiving and tightening members. A bridge having a slot therein disposed perpendicularly to the neck member is connected to the sounding board, remote from the neck member. A plurality of strings extends between the bridge and the string receiving and tightening members such that the strings can be releasably placed under tension. A saddle comprising an elongated, narrow strip of hard material, such as ivory, bone or hard plastic, is slidably fitted into the slot in the bridge to support the strings. When the strings are tightened, string tension presses the strings against the saddle and presses the saddle against the bottom of the slot in the bridge. When the instrument is played, vibrational energy from the strings is transmitted through the saddle and the bridge into the sounding board and into the body of the instrument, where the vibrational energy resonates and produces sound.

Conventionally, saddles for stringed instruments are formed from material having a generally uniform density along the length of the saddle. A common approach for amplifying the sounds generated by stringed instruments involves using conventional piezoelectric elements or pickups installed underneath the saddle of stringed instruments. Usually, one piezoelectric element is installed under each string or a piezoelectric film under the entire saddle. Examples of such arrangements are disclosed in U.S. Pat. No. 4,491,051 to Barcus, U.S. Pat. No. 4,567,805 to Clevinger and U.S. Pat. Nos. 4,944,209, 5,463,185 and 5,029,375 to Fishman. A drawback to these systems and other under the saddle pickup systems is that they rely on even pressure on each piezoelectric crystal element to produce an even string to string balance when amplified. Even pressure can be very hard to achieve as it relies on a very flat bottom on the saddle resting on the pickup and a very flat bottom to the bridge cavity on which the pickup rests. Minute pressure discrepancies will affect individual string volumes. This is a major complaint from installers and musicians. Also, because the under the saddle piezo pickups are resting in the bottom of the guitar bridge (in effect on the guitar body), they are very susceptible to feed back at medium to high volumes. Other pickup designs use a piezo element installed on the guitar body itself which are very susceptible to feedback and any noises from hands, arms and body touching or hitting the body of the guitar. As well, an under the saddle system interferes with the string vibration through the saddle to the guitar top when a user is playing without amplification. Furthermore, striking a string hard using an under the saddle pickup system can create what is known as a "piezo quack" effect resulting in distortion of the original string vibration signal.

SUMMARY OF THE INVENTION

The present invention addresses the drawbacks of existing saddle designs by providing, in some embodiments, a saddle for a stringed instrument comprising an elongate member having a string support surface for supporting strings of the instrument and a base opposite the string support surface for abutting a portion of the instrument, said elongate member having at least one internal cavity, an insert receivable in said at least one internal cavity and being dimensioned to provide an airspace gap between the insert and the base of the elongate member when the insert is received in said at least one internal cavity to provide a separation between the insert and said portion of the instrument, the insert being formed from a resonant material, at least one piezoelectric element embedded in said insert for producing electric signals from vibrations caused by the strings, and means for communicating the signals externally of the saddle extending from the at least one piezoelectric element.

The present invention addresses the drawbacks of existing saddle designs by providing, in some embodiments, a saddle for a stringed instrument comprising an elongate member having a string support surface for supporting strings of the instrument and a base opposite the string support surface for abutting a portion of the instrument, said elongate member having at least one internal cavity, a transducer element receivable in said at least one internal cavity for producing electric signals from vibrations caused by the strings, the transducer element being dimensioned to provide an airspace gap between the transducer element and the base of the elongate member when the transducer element is received in said at least one internal cavity to provide a separation between the transducer element and said portion of the instrument, and means for communicating the signals externally of the saddle extending from the transducer element. The transducer element may be a piezoelectric element, a piezoelectric film or an electret condenser film.

In a further aspect, the present invention provides a stringed instrument having such saddles. The stringed instrument may be a guitar including an acoustic guitar. Other stringed instruments such as a banjo, classical guitar, bazooki or ukulele can also be fitted with the saddle of the present invention. Multiple saddle units could be installed inside a piano bridge.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention,

FIG. 2 is a detail view of an embodiment of a saddle shown in FIG. 1 removed from the guitar and in an inverted position;

FIG. 3 is an exploded view showing the component parts of the saddle of FIG. 2 with a single piezoelectric element;

DETAILED DESCRIPTION OF THE INVENTION

Figure 1:
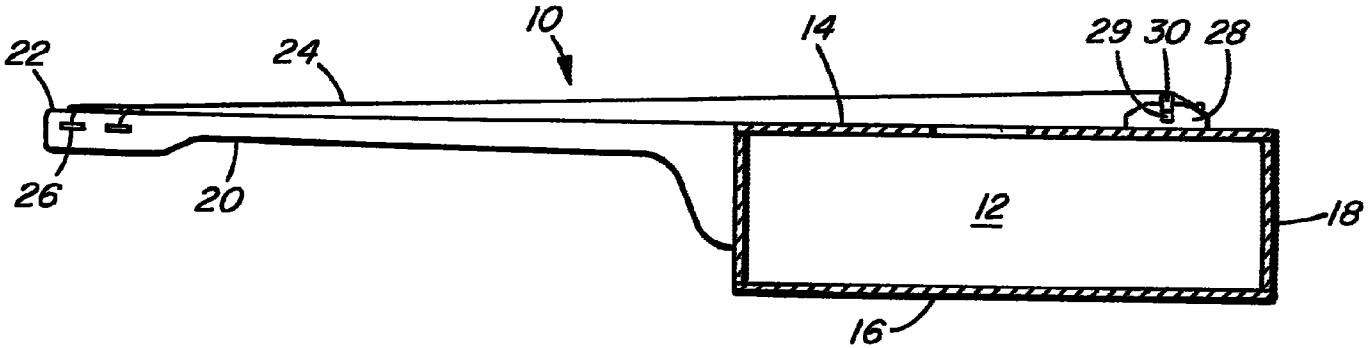
FIG. 1 is a perspective view of a guitar fitted with a saddle according to the present invention.

Referring to FIG. 1, a conventional stringed instrument 10 comprises a hollow body 12 having a front face 14 or sounding board, a back face 16 which is substantially parallel to the sounding board, and a connecting portion 18 which connects the sounding board to the back face around a perimeter of the respective faces. A longitudinally extending neck member 20 extends from the body and has a distal end 22 having a plurality of string receiving and tightening members 26. A bridge 28 having a slot 29 therein is connected perpendicularly to the sounding board 14, remote from the neck member 20. The plurality of strings 24 extends between the bridge 28 and the string receiving and tightening members 26 such that the strings can be releasably placed under tension. A saddle according to a first embodiment of the invention is shown generally at 30 and is slidably fitted into the slot 29 in the bridge 28 to support the strings 24. When the strings 24 are tightened, string tension presses the strings against the saddle 30 and presses the saddle against the bottom of the slot 29 in the bridge 28. Generally, when the instrument is played, vibrational energy from the strings 24 is transmitted through the saddle 30 and the bridge 28 into the sounding board 14 and into the hollow body 12 of the instrument 10, where it resonates and produces sound. The stringed instrument 10, for example may be a guitar or acoustic guitar. However, as those skilled in the art will appreciate, any instrument requiring a saddle to transmit vibrational energy from strings is contemplated.

Figure 1A:
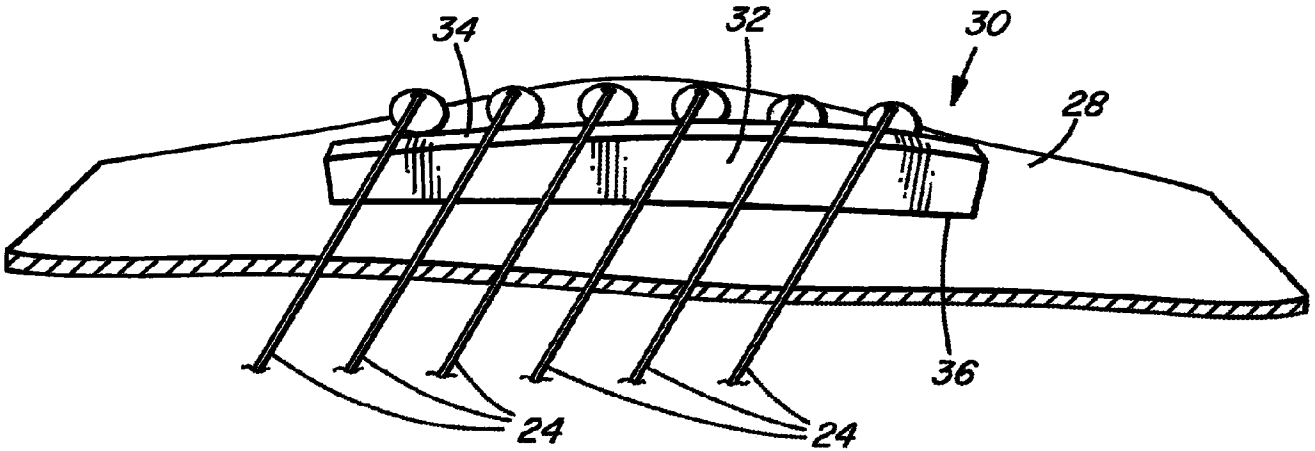
FIG. 1*a* is a detail view of the saddle of FIG. 1 in place in the bridge of the guitar.

Referring to FIGS. 1*a*, 2 and 3, the saddle 30 of the present invention comprises an elongate member 32 and may be formed of hard, resonant material, such as ivory, bone or hard plastic. The elongate member 32 further comprises a string support surface 34 for supporting the strings 24 and a base 36 for connecting to the bridge 28 by sliding into slot 29 or by other suitable mounting means.

In a preferred embodiment, elongate member 32 is formed with at least one internal cavity 38 as best shown in FIGS. 2 and 3. Internal cavity 38 may extend over substantially the full length of elongate member 32 or it may extend over only a portion of elongate member 32. The internal cavity 32 extends substantially parallel to support surface 34 and base 36. Elongate member 32 therefore comprises a hollow body having side walls 40, ends walls 42 with base 36 comprising an open region bounded by the lower surfaces of the side and end walls (as shown in FIGS. 3, 5, 7 & 8). Internal cavity 38 may be formed in the elongate member 32 during fabrication, for example, during moulding if the elongate member is formed of hard plastic or it may be drilled out of or otherwise cut from the elongate member 32 after fabrication.

In an embodiment of the saddle of the present invention, an insert 45 is receivable in internal cavity 38. Insert 45 preferably occupies substantially the full length of cavity 38 but it is not as high as cavity 38 is deep, thereby leaving an airspace gap 46 between the bottom 45' of the insert and the base 36 of the saddle (as best shown in FIG. 2). The insert may be formed from a resonant material having the same or a different density than the material of elongate member 32. The insert acts to transfer vibration along the entire insert to an embedded piezoelectric element as will be discussed below. The insert can be formed from the same material as the elongate member. Using different materials for the insert and the elongate member will tend to produce different amplified tones (e.g. deeper bass, more pronounced treble). Preferably, the insert is formed from a semi-crystalline material such as an epoxy resin, liquid crystal polymer (LCP) resin or polyphenylene sulfide (PPS) resin.

Alternatively, the insert 45 may comprise material selected from the group consisting of tungsten, lead, brass, aluminum, and plastic. Insert 45 is shaped to frictionally engage the sidewalls 40 of internal cavity 38 to prevent the insert from falling out of the elongate member 32 during operation and to ensure that the insert vibrates with the elongate saddle member. As a further alternative, the insert may be adhered in place by a suitable adhesive.

As best shown in FIG. 3, there is at least one piezoelectric element 48 embedded within insert 45. By way of example, piezoelectric element 48 may be a modified Lead Zirconate-Titanate piezo-element such as manufactured under the designation K-350 by Keramos, a division of Piezo Technologies. A person skilled in the art will understand that other piezoelectric materials are also suitable for use in the saddle of the present invention. Preferably, a single piezoelectric element is centrally located within insert 45. In a preferred arrangement, insert 45 is formed with an internal cavity to receive piezo electric element 48 which is embedded in place using a suitable adhesive such as epoxy. Piezoelectric element 48 is a conventional transducer element that receives vibrations transmitted by the strings through string support surface 34 of the saddle and through insert 45. Piezoelectric element 48 includes means for communicating a signal externally of the saddle in the form of a wire 50 extending from the piezoelectric element through the insert and exiting from the base of the saddle adjacent an end wall as best shown in FIG. 2. Wire 50 extends to a suitable amplifying unit (not shown) which amplifies the signal from the element. An alternative embodiment of the present invention may employ two piezoelectric elements embedded within insert 45, each element having its own wire to transmit signals to the amplifying unit (not shown) and the crystals are preferably equidistantly space within the insert and saddle. Other arrangements are possible in which three or more elements may be embedded in insert 45, however, any arrangement with more than one element requires testing of the elements for balance.

In use, insert 45 with one or more embedded element 48 is inserted into the cavity 38 by pressing into place, leaving an airspace gap 46 between the bottom edge 45' of the insert and the base 36, and then the saddle 30 is attached to the stringed instrument 10. Preferably, insert 45 includes a single embedded element 48. Insertion of insert 45 may occur during fabrication of the elongate member 32 or, if the saddle is available in kit form for retrofitting to an existing guitar, the insert 45 may be selected and inserted by a user into an elongate member at the time the saddle is fitted to the guitar. The use of a removable insert 45 makes it possible to readily adjust the height of the saddle by sanding or removal of a portion of the bottom of the saddle 30 before pressing the insert 45 into place within cavity 38 of elongate member 32, and attached the saddle to the stringed instrument. Inserts formed from different materials each with an embedded element 48 may be selected for insertion into cavity 38 of elongate member 32 depending upon the user's desired saddle tone. In addition, inserts with a different number of embedded piezoelectric elements may be selected for use.

The saddle of the present invention provides a compact and simple apparatus for reliably and accurately amplifying the sound of a guitar, particularly an acoustic guitar. In the saddle arrangement of the present invention, piezoelectric element 48 relies on vibration of the strings to generate a signal, but not on downward pressure as with conventional under-the-saddle pickups. Optimum string balance with the saddle of the present invention is much easier to achieve as each string does not have to be adjusted directly over an associated piezoelectric crystal. The airspace gap between the bottom edge of the insert and the base of the saddle means that no pressure is applied to the bottom of the pickup element, eliminating string imbalance due to uneven pressure between the saddle and the guitar bridge.

Figure 4:
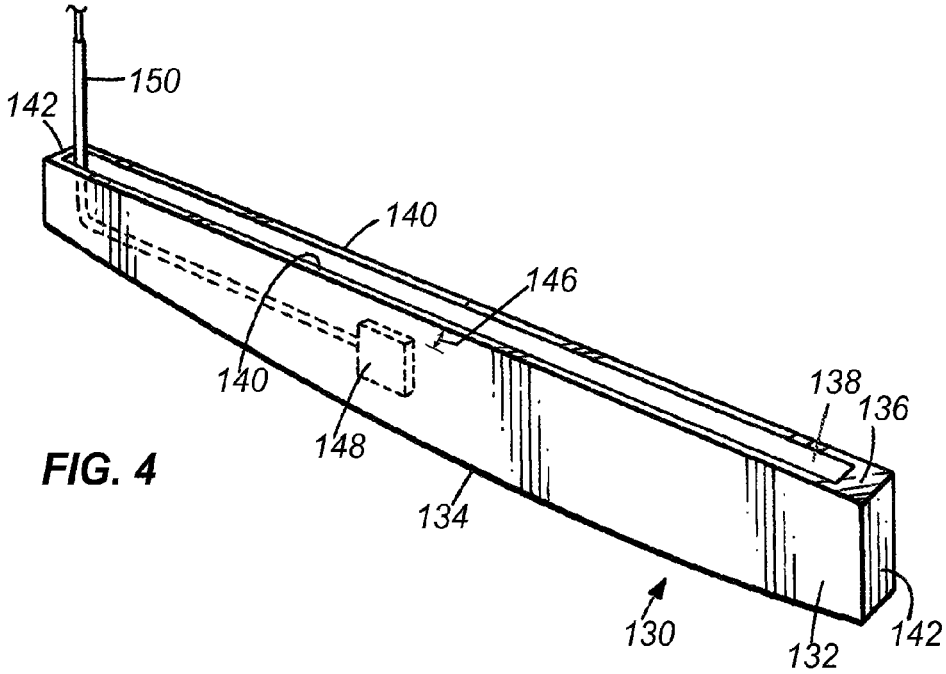
FIG. 4 is a detail view of another embodiment of a saddle shown in FIG. 1 removed from the guitar and in an inverted position.

Referring to FIG. 4, there is shown another embodiment of a saddle in accordance with the present invention. The saddle 130 comprises an elongate member 132 and may be formed of hard, resonant material, such as ivory, bone or hard plastic. The elongate member 132 further comprises a string support surface 134 for supporting the strings 24 and a base 136 for connecting to the bridge 28 by sliding into slot 29 or by other suitable mounting means. Elongate member 132 is formed with at least one internal cavity 138, which may extend over substantially the full length of elongate member 132 or it may extend over a portion of said length, and extends substantially parallel to support surface 134 and base 136. Elongate member 132 includes side walls 140, ends walls 142 with base 136 comprising an open region bounded by the lower surfaces of the side and end walls. A piezoelectric element 148 is mounted within the internal cavity 138 by frictional engagement with the side walls or using a suitable adhesive such as epoxy. It is important to note that an airspace gap 146 is provided between piezoelectric element 148 and base 136 to eliminate pressure being applied to the bottom of the piezoelectric element by the bridge 29, thereby eliminating string imbalance due to uneven pressure between the piezoelectric element and the guitar bridge. Piezoelectric element 148 is a conventional transducer element that receives vibrations transmitted by the strings through string support surface 134 and side walls 140 of the saddle. Element 148 includes means for communicating a signal externally of the saddle in the form of a wire 150 extending from the piezoelectric element and exiting from the base of the saddle adjacent an end wall as best shown in FIG. 4. Wire 150 extends to a suitable amplifying unit (not shown) which amplifies the signal from the element.

Figure 5:
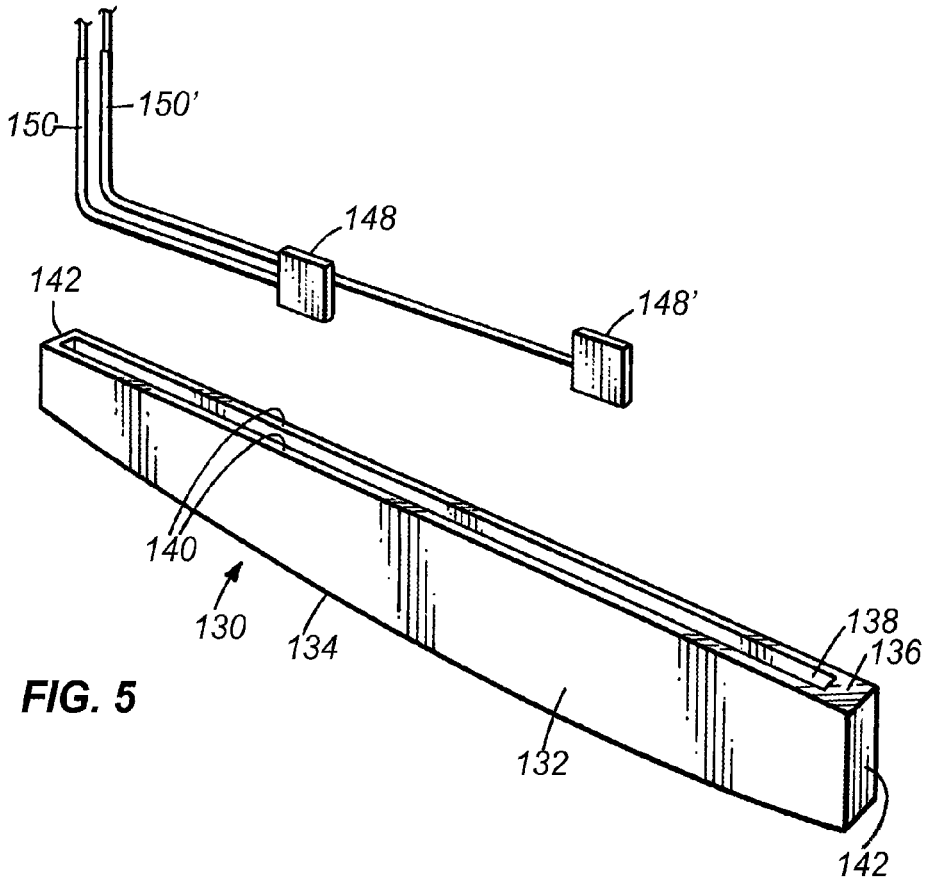
FIG. 5 is an exploded view of yet another embodiment a saddle shown in FIG. 1 removed from the guitar and in an inverted position with two piezoelectric elements.

FIG. 5 shows an alternative embodiment of saddle 130 which employs two piezoelectric elements 148 and 148' mounted within internal cavity 138. Each element is mounted so as to leave an airspace gap between the element and base 136, and each element has its own wire 150 or 150' to transmit signals to the amplifying unit (not shown) and the elements are preferably equidistantly space within the saddle. Other arrangements are possible in which three or more elements may be mounted in internal cavity 138, however, any arrangement with more than one element requires testing of the elements for balance.

Figure 6:
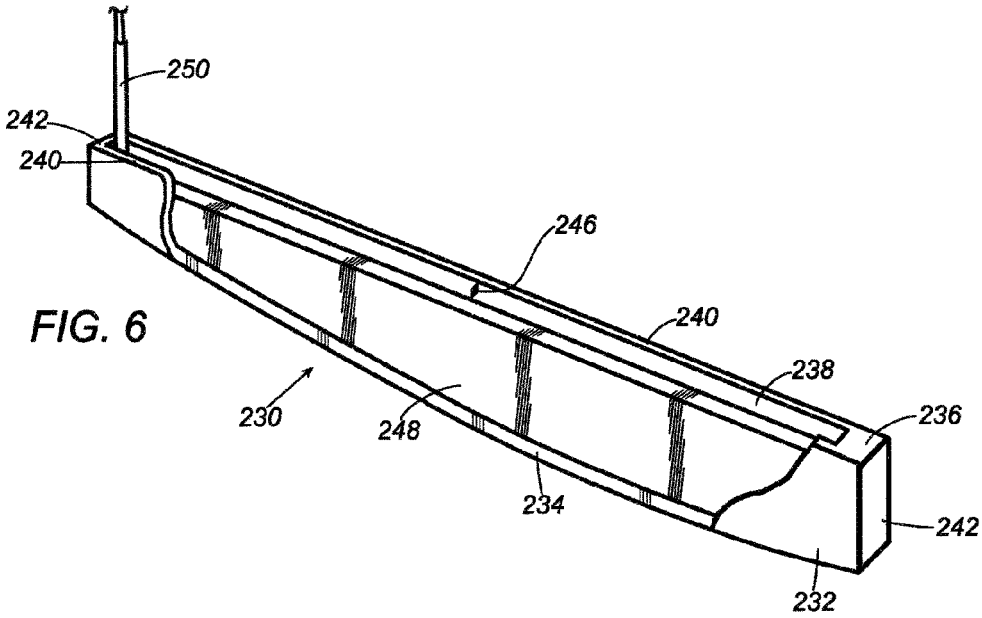
FIG. 6 is detail cutaway view of yet another embodiment of a saddle shown in FIG. 1 removed from the guitar and in an inverted position with a single elongate transducer pickup element.
Figure 7:
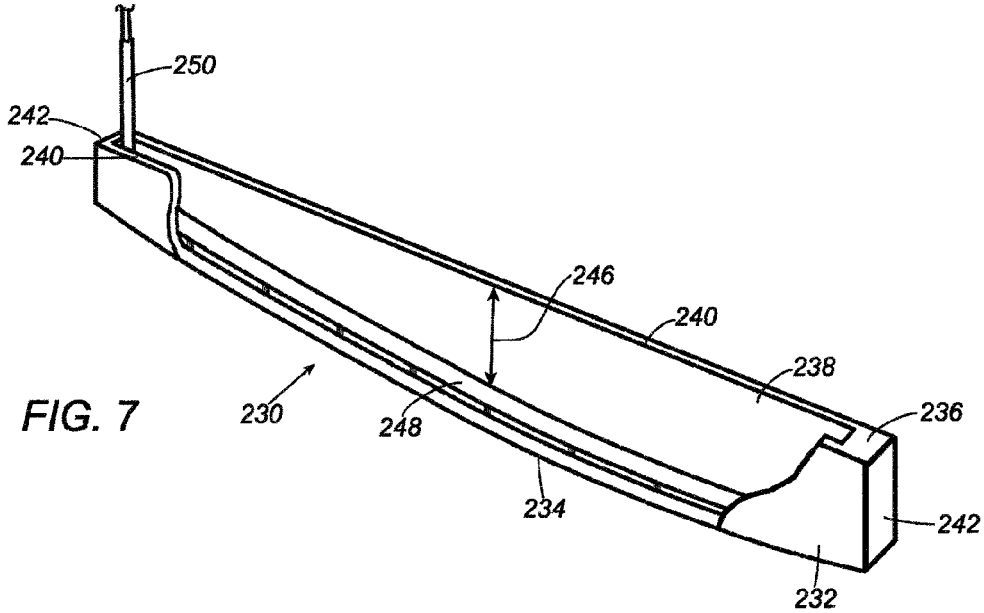
FIG. 7 is detail cutaway view of yet another embodiment of a saddle shown in FIG. 1 removed from the guitar and in an inverted position with a single thin film transducer pickup element.

Referring to FIG. 6, there is shown another embodiment of a saddle in accordance with the present invention. The saddle 230 comprises an elongate member 232 and may be formed of hard, resonant material, such as ivory, bone or hard plastic. The elongate member 232 further comprises a string support surface 234 for supporting the strings 24 and a base 236 for connecting to the bridge 28 by sliding into slot 29 or by other suitable mounting means. Elongate member 232 is formed with at least one internal cavity 238, which may extend over substantially the full length of elongate member 132 or it may extend over a portion of said length, and extends substantially parallel to support surface 234 and base 236. Elongate member 232 therefore comprises a substantially hollow body having side walls 240, ends walls 242 with base 236 comprising a substantially open region bounded by the lower surfaces of the side and end walls. A transducer or pickup element 248 is mounted within the internal cavity 238 by frictional engagement with the side walls or using a suitable adhesive such as epoxy. It is important to note that an airspace gap 246 is provided between pickup element 248 and base 236 to eliminate pressure being applied to the bottom of the pickup element by the bridge 29, thereby eliminating string imbalance due to uneven pressure between the saddle and the guitar bridge. Pickup element 248 may comprise a piezoelectric film, one long piezoelectric element or an eletret condenser film, and acts as a transducer that receives vibrations transmitted by the strings through string support surface 234 and side walls 240 of the saddle and converts said mechanical energy into electrical energy. Pickup element 248 includes means for communicating a signal externally of the saddle in the form of a wire 250 extending from the pickup element and exiting from the base of the saddle adjacent an end wall. Wire 250 extends to a suitable amplifying unit (not shown) which amplifies the signal from the pickup element. FIG. 7 shows an alternative configuration of saddle 230 which employs a thin strip electret element as the pickup element 248, such as a thin strip elastic electret film produced by B-Band Ltd. of Finland.

The saddles of the present invention provide a compact and simple apparatus for reliably and accurately amplifying the sound of a guitar, particularly an acoustic guitar. In the saddle arrangements of the present invention, the pickup element relies on vibration of the strings to generate a signal, but not on downward pressure as with conventional under-the-saddle pickups. Optimum string balance with the saddle of the present invention is much easier to achieve as each string does not have to be adjusted directly over an associated piezoelectric crystal. The airspace gap between the pickup and the base of the saddle means that no pressure is applied to the bottom of the pickup element, thereby eliminating string imbalance due to uneven pressure between the saddle and the guitar bridge.

The saddles of the present invention avoids the "piezo quack" effect that can result from striking a string hard using an under the saddle pickup system. The pickup element of the present invention housed inside the cavity of the elongate saddle member is closer to the strings than conventional under the saddle piezo-electric pickups resulting in a stronger signal from the string vibration and less body vibration getting to the embedded pickup element which allows for higher levels of volume before feedback.

The saddles of the present invention with its unique structure offers reduced manufacturing costs as the saddle can use a single pickup element (transducer) rather than the six separate piezoelectric crystals of conventional under the saddle arrangements. This also eliminates testing of six crystals for balance before they are assembled into an under the saddle system.

A further advantage of the saddles of the present invention is that the external appearance of the saddle is entirely conventional and does not distract from the traditional appearance of the instrument. The saddle retains the traditional look of many acoustic instruments, especially acoustic guitar, as the internal insert and/or the pickup element are completely hidden and cannot be detected looking at the bridge and saddle once installed. Particularly with acoustic instruments, this is an important consideration as acoustic musicians have a deep tradition of retaining the "stock look" of their instrument.

While specific embodiments of the invention have been described and illustrated, such embodiments should be considered illustrative of the invention only and not as limiting the invention as construed in accordance with the accompanying claims.

What is claimed is:

1. A saddle for placement into a complementary slot in a bridge on a body of a stringed instrument, the saddle comprising:

a one piece elongate member having a top edge with a string support surface for supporting strings of the instrument and a base opposite the string support surface for abutting a portion of the bridge, said elongate member having at least one internal cavity that extends from the base to the top edge;

a transducer element received in said at least one internal cavity for producing electric signals from vibrations caused by the strings, the transducer element being dimensioned to provide an airspace gap between the transducer element and the base of the elongate member when the transducer element is received in said at least one internal cavity to provide a physical separation between the transducer element and said portion of the bridge in a manner such that no portion of a bottom of the transducer element is in direct or indirect contact with said portion of the bridge; and means for communicating the signals externally of the saddle extending from the transducer element.

2. The saddle of claim 1 wherein the transducer element is a piezoelectric element.

3. The saddle of claim 1 wherein the transducer element is a piezoelectric film.

4. The saddle of claim 3 wherein said cavity extends parallel to said support surface and said base for substantially the full extent of said support surface, and the piezoelectric film is substantially as long as the cavity.

5. The saddle of claim 1 wherein the transducer element is an electric condenser film.

6. The saddle of claim 5 wherein said cavity extends parallel to said support surface and said base for substantially the full extent of said support surface, and the electric condenser film is substantially as long as the cavity.

7. A stringed instrument having a saddle as claimed in claim 1.

* * * * *